US007007328B1

(12) United States Patent
Bailey

(10) Patent No.: US 7,007,328 B1
(45) Date of Patent: Mar. 7, 2006

(54) SYSTEM AND APPARATUS FOR UPPER BODY SUPPORT OF A RECUMBENT PERSON

(75) Inventor: Terry Bailey, 5609 Millar Dr., Dallas, TX (US) 75236

(73) Assignee: Terry Bailey, Dallas, TX (US)

( * ) Notice: Subject to any disclaimer, the term of this patent is extended or adjusted under 35 U.S.C. 154(b) by 0 days.

(21) Appl. No.: 10/982,423

(22) Filed: Nov. 5, 2004

(51) Int. Cl.
*A47G 9/00* (2006.01)

(52) U.S. Cl. ..... 5/632; 5/640; 5/657

(58) Field of Classification Search ..... 5/632, 5/630, 633, 640, 657, 722, 723, 420, 634; D6/601
See application file for complete search history.

(56) References Cited

U.S. PATENT DOCUMENTS

| | | | | | |
|---|---|---|---|---|---|
| 3,009,172 | A | | 11/1961 | Eidam | 5/338 |
| 3,333,286 | A | * | 8/1967 | Biolik | 5/632 |
| 3,648,308 | A | | 3/1972 | Greenawalt | 5/338 |
| 4,635,306 | A | | 1/1987 | Willey | 5/431 |
| 4,802,249 | A | * | 2/1989 | Bills | 5/420 |
| 4,970,742 | A | | 11/1990 | Keener | 5/431 |
| D318,392 | S | * | 7/1991 | Edelson | 248/145 |
| 5,432,967 | A | | 7/1995 | Raftery | 5/633 |
| D366,527 | S | | 1/1996 | Paterson | D24/158 |
| 5,581,831 | A | | 12/1996 | Xiang | 5/636 |
| 5,623,050 | A | * | 4/1997 | Kitada et al. | 530/324 |
| 5,836,653 | A | | 11/1998 | Albecker | 297/452.31 |
| D406,210 | S | | 3/1999 | Johnson | D6/601 |
| D446,676 | S | | 8/2001 | Mayes | D6/601 |
| 6,292,964 | B1 | * | 9/2001 | Rose et al. | 5/630 |
| 6,360,387 | B1 | | 3/2002 | Everhart | 5/630 |
| 6,578,217 | B1 | * | 6/2003 | Roberson | 5/632 |
| 6,721,978 | B1 | | 4/2004 | Tankersley | 5/652 |
| 6,735,798 | B1 | | 5/2004 | Sekizawa | 5/632 |

* cited by examiner

*Primary Examiner*—Alexander Grosz
(74) *Attorney, Agent, or Firm*—Akin Gump Strauss Hauer and Feld LLP

(57) ABSTRACT

A device for upper body support of a recumbent person is provided, which comprises a first support portion, a second support portion, each of which is wedge-shaped. Each portion is, in vertical cross-section, substantially a right triangle. The longest surface of each portion forms a support surface and the thin end of the wedge of the first portion is hingedly connected to the support surface of the second portion at a position spaced from the thick end of the support surface of that portion. The portions are formed of a solid, yielding support material, such as polyurethane foam. Preferably the support portions have a water proof outer surface.

8 Claims, 1 Drawing Sheet

SYSTEM AND APPARATUS FOR UPPER BODY SUPPORT OF A RECUMBENT PERSON

FIELD OF THE INVENTION

The present invention pertains to the support of a person who is in a recumbent position for an extended period of time and provides a device which will minimize or reduce stress on the upper body.

BACKGROUND OF THE INVENTION

The present invention relates to a device intended to be used by a plumber or handyman in situations in which that person needs to be recumbent and positioned on his/her back while working.

Prior art devices have failed to provide a device which provides adequate support, but which is readily transportable between job locations.

SUMMARY OF THE INVENTION

In accordance with the present invention, a device for upper body support of a recumbent person is presented that overcomes known problems with previous methods for body support.

In particular, a device for upper body support of a recumbent person is provided that allows prevention of or reduction of stress on the upper body over an extended period of time.

In accordance with an exemplary embodiment of the present invention, a device for upper body support of a recumbent person is provided. The device for supporting the upper body of a recumbent person comprises a first support portion, a second support portion, each of which is substantially wedge-shaped. Each portion preferably is, in vertical cross-section, a right triangle. In some forms of the invention, one or more of the support portions is truncated, so that the narrow end of the wedge does not completely taper. The support portions are hingedly interconnected and can be moved with respect to each other between a folded position and an opened, working, position. In the open position, the longest surface of each support portion forms a support surface for the recumbent person. The second support portion which provides an extension of the supporting surface of the first support portion, can be reinforced by a flat, rigid support member disposed inside the cover of the second support portion and adjacent to its upper surface. The support portions are preferably formed of a solid, yielding support material, such as polyurethane foam. Advantageously the support portions have water proof outer surfaces.

The present invention provides many important technical advantages. One important technical advantage of the present invention is a system and apparatus for supporting the upper body that uses two interconnected and foldable portions. This allows portability in that the device may be folded and carried. In a preferred form of the invention, a handle extends from the end surface of the second support portion.

Those skilled in the art will further appreciate the advantages and superior features of the invention together with other important aspects thereof on reading the detailed description that follows in conjunction with the drawings.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the present invention, there is shown in the drawings embodiments which are presently preferred. It will be understood, however, that the invention is not limited to the precise arrangements shown.

In the drawings.

DETAILED DESCRIPTION OF THE INVENTION

Figure 1:
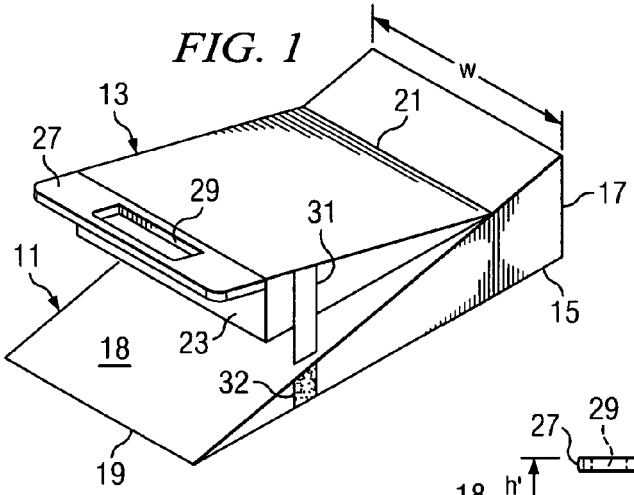
FIG. 1 is a side perspective view of a first body support device embodying the invention, shown in an intermediate position between the folded condition and the open condition.

In the description that follows, like parts are marked throughout the specification and drawings with the same reference numerals. The drawing figures are not necessarily to scale, and certain components can be shown in generalized or schematic form and identified by commercial designations in the interest of clarity and conciseness.

Figure 2:
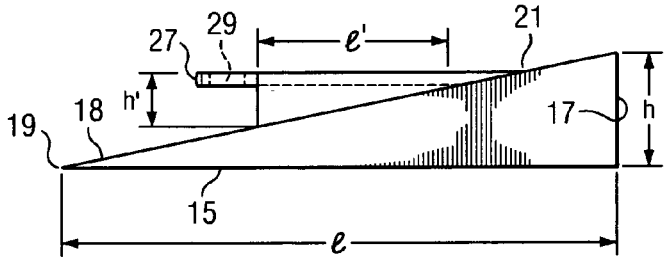
FIG. 2 is a side elevation of the device of FIG. 1 in the folded condition.
Figure 3:
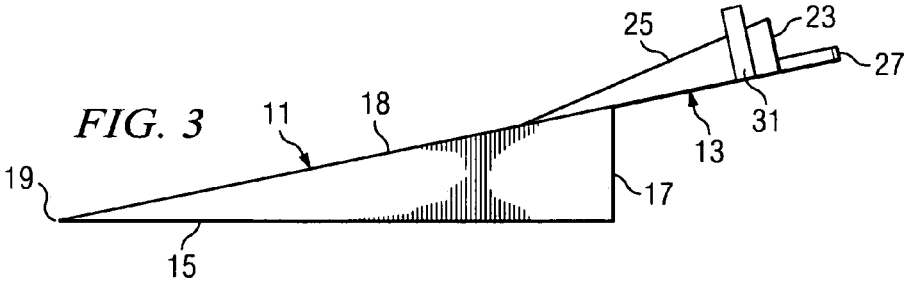
FIG. 3 is a side elevation of the device shown in FIG. 1 in the opened condition.

A first exemplary embodiment of the invention, namely a device for supporting the upper body of a recumbent person, for example a plumber working under a domestic sink, is shown in FIGS. 1–3 of the drawings. The device comprises a first support portion 11 and a second support portion 13, both formed of a solid, yielding support material, such as 54 lb density polyurethane foam. Both portions 11 and 13 have a waterproof outer surface. Preferably, the waterproof outer surface is formed integrally with the respective portion 11 or 13. In an alternative version of the invention, each portion 11 and 13 has a removable, waterproof cover of, for example, canvas.

The portion 11 is wedge-shaped, right triangular in vertical cross-section, having a lower surface 15, an end surface 17 extending upwardly at 90° to the lower surface 15 and an upper supporting surface 18 that extends downwardly from the top of the end surface 17 to a tapered end 19. The first portion 11 is preferably 24 inches long (l in FIG. 2), from the end surface 17 to the tapered end 19, 12 inches wide (w in FIG. 1) across the tapered end 19 and the end surface 17 is 6 inches high (h in FIG. 2).

The second support portion 13 is also wedge-shaped, right triangular in vertical cross-section, having a tapered end 21, an end surface 23, and a supporting surface 25. It has the same width w the first portion 11, but is only 11.5 to 12 inches long ($l^1$ in FIG. 2) and 3 inches deep ($h^1$ in FIG. 2) at the end surface 23.

The second portion 13 also includes a flat, rigid support member 27 disposed inside the cover of the support portion 13 and adjacent to its supporting surface 25. The support member 27 is preferably formed of polyurethane plastic material or half inch thick polyethane. An outer end of the support member 27 preferably extends beyond the end surface 23 of the second support portion 13 and provides a handle 29 by which the device can be carried.

The first and second portions 11 and 13 are hingedly interconnected along an axis extending across the width of the device and located on the support surface 18 of the first support member 11 about 3.5 to 4 inches from the end surface 17 of the first portion 11 and at the top-end 21 of the second portion 13. The interconnection is such that the second portion 13 can be moved between a folded position, in which the whole of the second portion 13 is disposed on the upper surface 18 of the first portion 11, and an extended position in which the end surface 23 of the second portion 13 is disposed beyond the end surface 17 of the first portion 11 and the upper supporting surface 25 of the second portion 13 forms an extension of the upper supporting surface 18 of the first portion 11.

The hinged interconnection can be formed by sewing the two portions 11 and 13 together along the axis, or by forming the two portions 11 and 12 with an interconnecting web portion located along the axis that acts as a hinge.

In an alternative version, the two portions are not permanently interconnected, but have a detachable connector, such as respective matching pieces of Velcro™ material attached or formed along the upper supporting surfaces 18 and 25 of the two support portions 11 and 13. In a further alternative, cooperative zipper portions may be provided in the respective upper support surface 18 of the first support portion 11 and the tapered end 21 of the second portion 13.

A fastener comprising cooperative pieces 31 and 32 of Velcro™ material is provided to retain the two portion 11 and 13 together in the folded condition of the device. As seen in FIG. 1, the first fastener piece 31 is mounted on the side of the support portion 13 and extends beyond the support surface 25. The operative surface of the Velcro™ material of the piece 31 faces inwardly. The second fastener piece 32 is mounted on the side of the support portion 11 with its operative surface facing outwardly. The fastener piece 32 is positioned such that, when the support portions 11 and 13 are in the folded condition, the first piece 31 overlies the second piece 32, allowing the operative surface of the fastener pieces to releasably engage.

Figure 4:
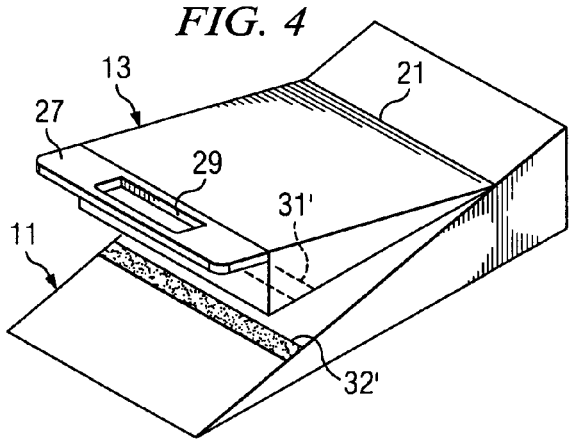
FIG. 4 is a side perspective view of an alternative form of body support device embodying the invention, shown in an intermediate position between the folded condition and the opened condition.

FIG. 4 shows a second embodiment of the invention. The device of FIG. 4 is essentially similar to that shown in FIGS. 1–3, except that the fastener is provided by two cooperative pieces of Velcro™ material 31' and 32' disposed across the width of the supporting surfaces 18 and 25 of the support portion 11 and 13 respectively.

Figure 5:
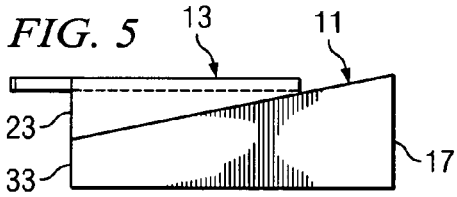
FIG. 5 is a side elevation illustrating a further alternative form of body support device embodying the invention.

FIG. 5 shows a further embodiment of the invention. The device shown in FIG. 5 is generally similar in construction and operation to the device shown in FIGS. 1–3, except that the supporting portion 11 is not a complete right triangle in vertical cross-section. Rather, it is truncated towards its narrow end, so that it does not completely taper to a point. Its length is 15 inches ($l^1$ in FIG. 5) and the surface 23 of the second support portion is aligned with the truncated end surface 33 of the first support portion 11 when the support portions are in the folded position.

What is claimed is:

1. A device for supporting the upper body of a recumbent person comprising:

a first wedge-shaped, support portion having a substantially right-triangular cross-section with its largest surface adapted to provide support for the body when the device is used;

a second wedge-shaped support portion having a substantially right-triangular cross-section with its largest surface adapted to provide support for the body when the device is used;

the second support portions being connected to the first support portion by a hinged connection that connects the thin end of the wedge of the second support portion to the largest surface of the first support portion to enable the second support portion to be moved relative to the first support portion between a folded condition in which the largest surface of the second support portion is against the largest surface of the first support portion and a opened, working position in which the second support portion extends beyond the first support portion, with the largest surface of the second support portion providing an extension of the largest surface of the first support portion to provide support for the recumbent person.

2. A device as claimed in claim 1, wherein the second support portion includes a rigid support member disposed within the second portion and disposed adjacent to the surface of the second support portion that is in contact with the largest surface of the first support portion when the device is in the open, working condition.

3. A device as claimed in claim 2, wherein the support member extends beyond the second support portion and provides a handle for the device.

4. A device as claimed in claim 1, wherein the first and second support portions have waterproof outer surfaces.

5. A device as claimed in claim 4, wherein the waterproof outer surface are formed integrally with the first and second support portions.

6. A device as claimed in claim 5, wherein the waterproof outer surface are provided by covers in which the first and second support portions are accommodated.

7. A device as claimed in claim 1, wherein the first and second support portions are formed of polyurethane foam.

8. A device as claimed in claim 1 wherein the first support portion has a a truncated narrow end in vertical section.

* * * * *